US005232104A

United States Patent [19]

Francois

[11] Patent Number: 5,232,104

[45] Date of Patent: Aug. 3, 1993

[54] DISPLAY UNIT WITH REMOVABLE FRONT

[75] Inventor: Alain Francois, Meudon, France

[73] Assignee: Coloride Inc., Louiseville, Canada

[21] Appl. No.: 673,389

[22] Filed: Mar. 22, 1991

[51] Int. Cl.[5] ..... A47F 7/00

[52] U.S. Cl. ..... 211/86; 108/28

[58] Field of Search ..... 211/86, 88, 134; 108/28

[56] References Cited

U.S. PATENT DOCUMENTS

| | | | |
|---|---|---|---|
| 1,108,692 | 8/1914 | Burd | 211/86 X |
| 1,285,158 | 11/1918 | Haynes | 211/86 X |
| 2,639,040 | 5/1953 | Tapley | 211/86 |
| 3,239,182 | 3/1966 | Blanz | 211/86 X |
| 3,647,078 | 3/1972 | Fortunato | 211/88 X |
| 3,776,388 | 12/1973 | Mattheis | 211/86 |
| 4,613,049 | 9/1986 | Walker | 211/88 |

*Primary Examiner*—Robert W. Gibson, Jr.
*Attorney, Agent, or Firm*—Robic

[57] ABSTRACT

A removably mountable front to be mounted on a display unit. This mountable front comprises at least two sides joining each other at an acute angle as to form therebetween, a V-shaped removably mountable front. One of the sides is releasably attachable onto a display unit. Many embodiments are disclosed. One has a pair of rectangular-triangularly shaped sidewalls, a large wall, a front wall and a smallest wall. The hypotenuse of the sidewalls define the edge for receiving the front wall of the mountable front. The large size of said triangularly shaped sidewalls defines the edges common to the large wall. The small side of the triangularly shaped sidewalls defines the edges common to the smallest wall of mountable front. Coupling intermediates are also disclosed for rotatably mounting a removably mountable front to a display unit.

21 Claims, 5 Drawing Sheets

DISPLAY UNIT WITH REMOVABLE FRONT

BACKGROUND OF THE INVENTION

1. Field of the invention

This invention relates to a mountable front element for a display unit and to a display unit having such mountable front. It also relates to coupling intermediates for use therewith.

2. Description of related art

Display units are well known. They generally consisting a tray having therein a plurality of products and a front molded with the tray and integral therewith.

SUMMARY OF THE INVENTION

Broadly stated, the invention is directed to the combination of a display unit with a removably mountable front especially adapted for use therewith, the unit having a front wall on which the front is intended to be removably mounted, wherein the front comprises at least two walls joining each other at an angle; and wherein attaching means are provided on the front wall of the unit and on one of the walls of the front for attaching this front to the front wall in a removable manner.

In accordance with a preferred embodiment of the invention, the attaching means preferably comprises an L-shaped extension projecting forwardly and upwardly from the front wall of the unit, and at least one recess made in at least one of the walls of the front, the L-shaped extension and recess being sized and positioned to allow the L-shaped extension to be inserted through the recess and then the front to be slid down in a position where part of the one wall of the front is squeezed between the front wall of the unit and the L-shaped extension.

Preferably, the L-shaped extension is of the same size as the recess to transversally lock the front relative to the front wall of the unit when the front has been slid down into the L-shaped extension.

Other features of this invention will become apparent upon ready the follow non restrictive description of several preferred embodiments thereof.

DESCRIPTION OF THE DRAWINGS

In the drawings which illustrate particular embodiments of the invention.

DESCRIPTION OF A PREFERRED EMBODIMENT

Figure 1:
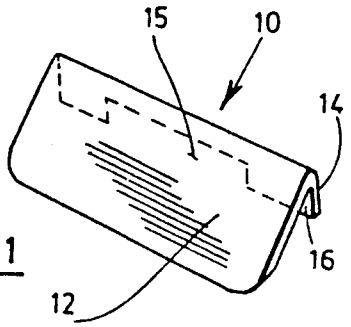
FIG. 1 is a perspective view of a mountable front.
Figure 3:
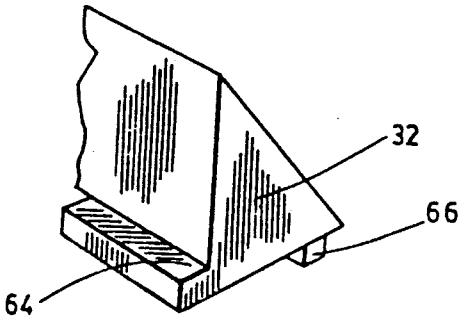
FIG. 3 is an enlarged view of one of the sidewalls of the mountable front shown in FIG. 2.

FIG. 1 shows a removably mountable front (10) to be mounted on a display unit. The front (10) has two walls (12) and (14) joining each other at an acute angle (16) as to form a V-shaped front. The wall (14) is connectable to a display unit (20), such as shown in FIG. 2, having a substantially L-shaped extension (22) projecting upwardly from its front wall (24), by squeezing of the wall (14) between the L-shaped extension (22) and the wall (24) of the display unit (20).

Figure 2:
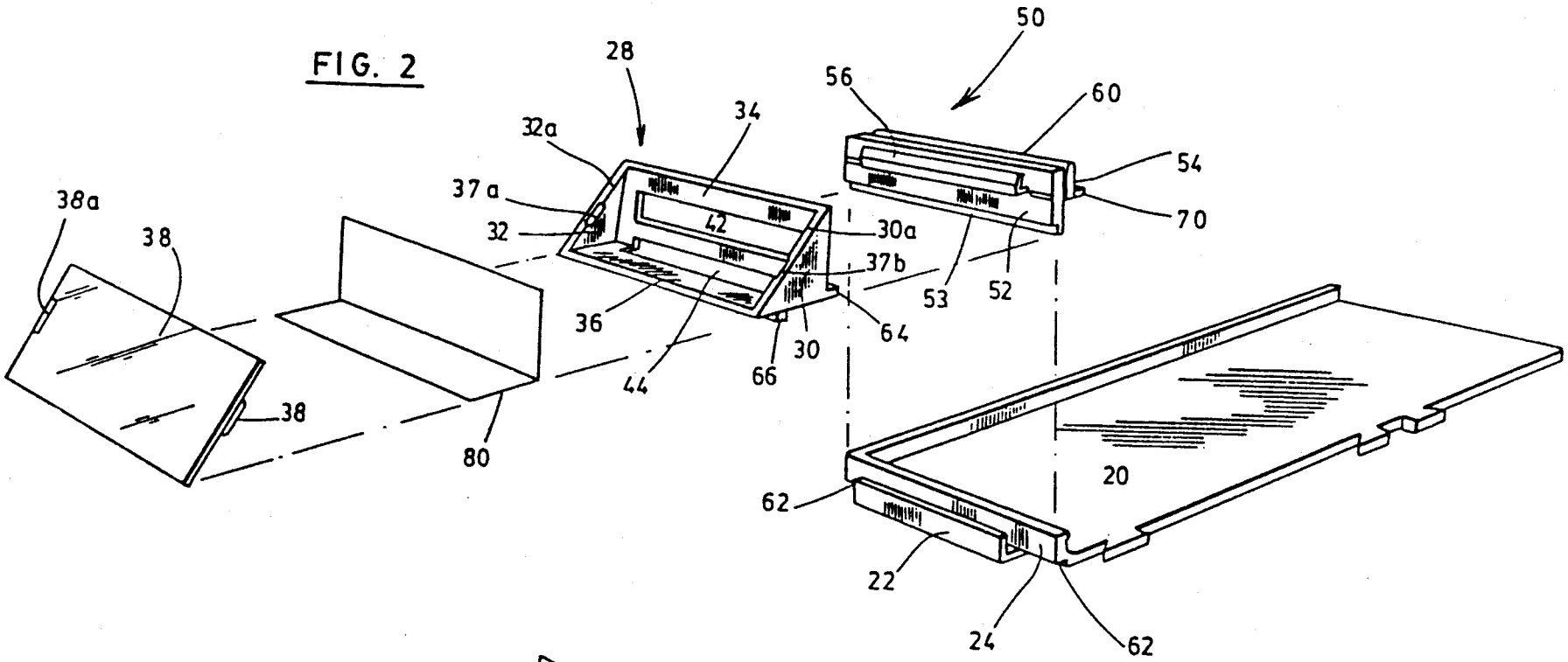
FIG. 2 is an exploded view illustrating another version of a mountable front, a coupling intermediate which is optional, for receiving said front, and a display unit for receiving either said intermediate, having said front, or said mountable front.

FIG. 2 shows another removably mountable front. It has a pair of rectangular-triangularly shaped sidewalls (30), (32), a large wall (34) and a small wall (36), the hypotenuses of said sidewalls defining edges (30*a*) and (32*a*) for receiving a front wall (38). The large side of the triangularly shaped sidewalls (30) and (32) define edges common to the large wall (34) and the small side of the triangularly shaped sidewalls (30) and (32) define edges common to the smallest wall (36). At least the large wall (34) is provided with one or more slots such as (42) and (44), in which may be inserted the L-shaped extension (22) to releasably secure the mountable front to the display (20) by squeezing the large o the small wall between said L-shaped extension (22) and the wall (24) of the display unit (20).

Preferably, the edges mountable front wall (38) is removably mounted on the edges of the sidewalls (30), (32), and of the large and small walls (34) and (36).

In a preferred embodiment, the edges of the sidewalls adjacent the front wall and the front wall and the front wall near its edges adjacent the sidewalls are provided with male portions (38*a*) and female portions (37*a*), (37*b*), that can engage for locking in the front wall (38) to the sidewalls (30), (32).

Still in a preferred embodiment, the mountable front is provided with two slots (42), (44), as shown in FIG. 2. These slots have the shape of the front of the L-shaped extension of the display unit as will be discussed hereinbelow. Preferably, this shape is rectangular, though it need not be.

Still in another preferred embodiment, the large wall is provided with a slot extending along the longitudinal axis of the large wall as shown at (42).

In another embodiment, the mountable front is provided with a slot obtained by a rectangular cut near the edge of the large wall (34) adjacent the small wall as shown at (43) and a rectangular cut on the small wall (36) adjacent the large wall as shown at (44).

The position of the slots may vary as one wishes.

Preferably also, as shown in FIG. 2, the display unit is a tray having at one of its walls (24), an upwardly oriented directed L-shaped element (22) for receiving the mountable front described above, by insertion of one of its slots such as (42) or (43), (44) onto the upwardly oriented L-shaped element (22) and sliding the large or small wall side such as (34) or (36) between said L-shaped element (22) and the side (21), thereby to releasably secure the mountable front to the tray. The front of the L-shaped element is preferably rectangular, as is better shown in FIGS. 5 and 6, though it need not be and may take other forms if desired. However, it preferably should be complementary to the shape of the slots (42) and (44) which may take other forms. Other hooking or releasably fastening means may be used if desired.

As is also shown in FIG. 2, the mountable front may, instead of engaging the L-shaped extension (22) of the tray (20), engage a coupling intermediate (50) having two walls: a large rectangular wall (52) and a small wall (54). The large wall (52) has an L-shaped extension (56) mounted thereon. The small wall (54) is pivotably mounted on the large wall (52) along the longitudinal edges (60) of this wall (52) that is pointed by said L-shaped extension (56), and the small wall (54) is provided with means slidably insertable into the L-shaped element of the display unit as shown at (22).

Preferably, as shown in FIG. 2, the display unit comprises a groove (62) and the removably mountable front has tongues such as shown at (64), (66) sized and positioned to fit into said groove, one of said tongues mounted on said mountable front being engageable with the groove (62) to releasably lock in said front to said display unit (20), thereby providing means to lock the removably mountable front onto the display unit. It is to be understood that the groove (62) and the tongues (64), (66) are not essential, and that the tongues could be emasculated and the grooves suppressed.

Figure 4:
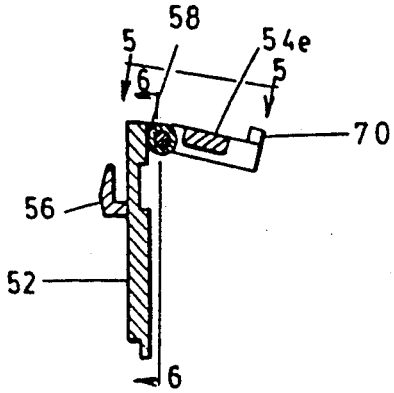
FIG. 4 is a cross-sectional view of the coupling intermediate in an open position.
Figure 5:
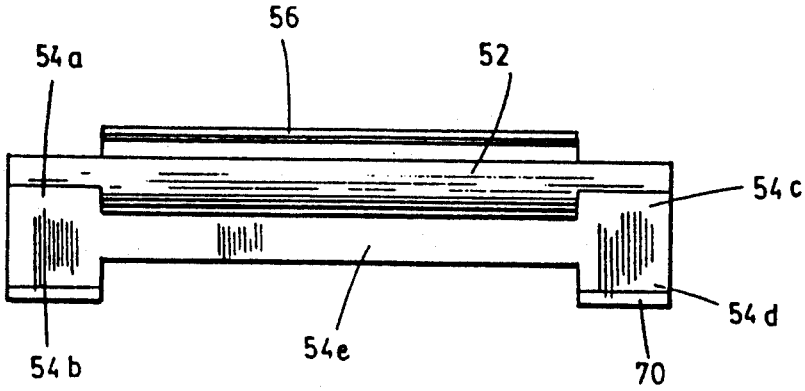
FIG. 5 is a face view along line 5—5 of FIG. 4.

Preferably, the longitudinal edge of the large wall (52) of the coupling intermediate (50) pointed by the L-shaped extension (56), projects perpendicularly to the surface of the wall (52), as is better shown in FIGS. 4 and 5.

Figure 6:
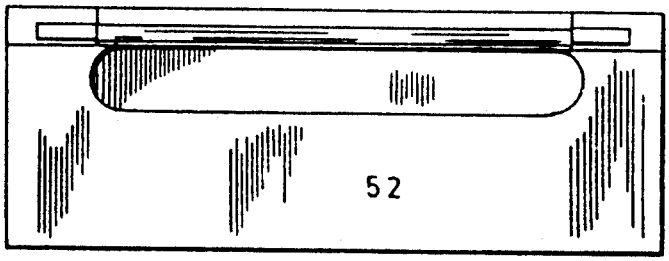
FIG. 6 is a face view along line 6—6 of FIG. 4.

Referring to FIGS. 4 to 6 and better shown on FIG. 5, the small wall (54) of the coupling intermediate (50) is preferably H-shaped, and thus comprises four legs (54*a* to 54*d*) joined by a transversal bar or joining member (54*e*). The thickness of the legs of the H-shaped small wall (54*a*), 54*b*), (54*c*) and (54*d*) is about twice the thickness of the joining member (54*e*), as shown in FIG. 4. The joining member (54*e*) joins the outermost portion of the legs, whereby the legs act as guides to enable easy insertion of the member (54*e*) joining the legs between the L-shaped extension of a display unit as shown at (22) in FIG. 2 while the L-shaped extension mounted on said coupling intermediate is engaged by a removably mounted front.

Figure 7:
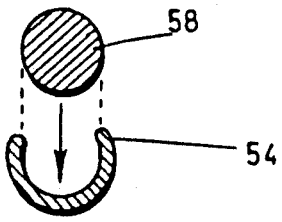
FIG. 7 is an enlarged view of the pivot connection of the coupling intermediate shown in FIGS. 3 to 6.

In a particular embodiment, the L-shaped extension (56) is provided with rods (56*a*), (56*b*), integral therewith. Legs (54*a*) and (54*c*) have respectively a cavity defining a housing for receiving the end of the rods (56*a*), (56*b*) when the housing is partly open, as shown in FIG. 7. Insertion of the respective ends of the rods (56*a*), (56*b*) into their respective housing, defined in (54*a*) and (54*c*), is achieved by pressing said rods into said housings, by a snap-on action. The wall (52) itself is provided with an L-shaped element (58) similar to the L-shaped element (22).

This coupling intermediate enables rotation of the removably mountable front so that written inscription such as factory number, number of samples remaining or other information valuable to a retailer may be placed within the space between the walls (52) and (54), or on said walls within said space.

Figure 8:
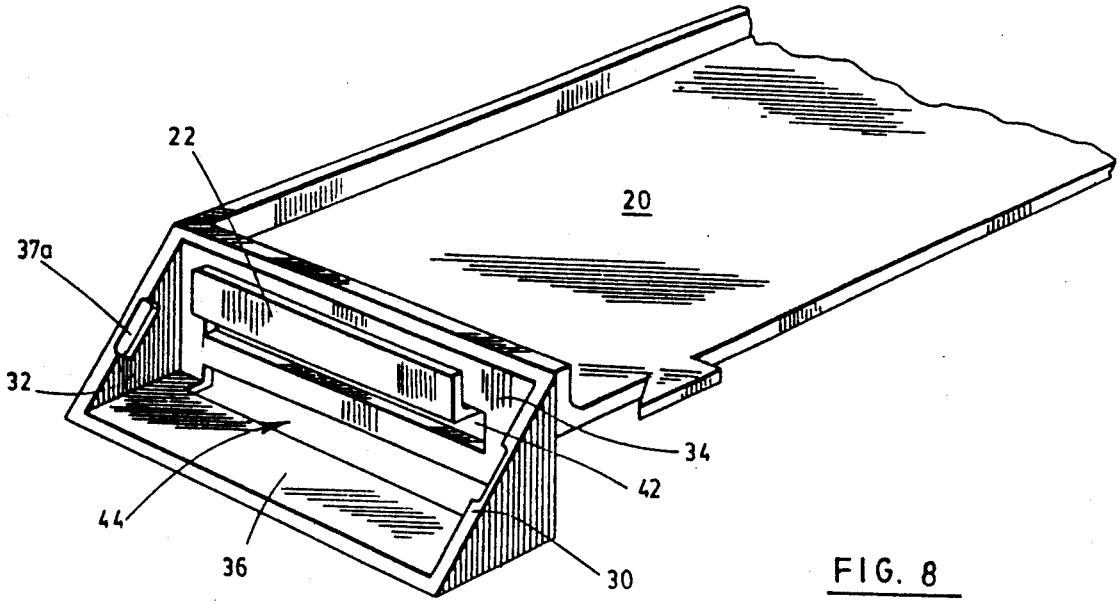
FIG. 8 is a perspective view of a mountable front as shown in FIG. 2 directly mounted on a display unit using the slot extending along the longitudinal axis of the large size.
Figure 11:
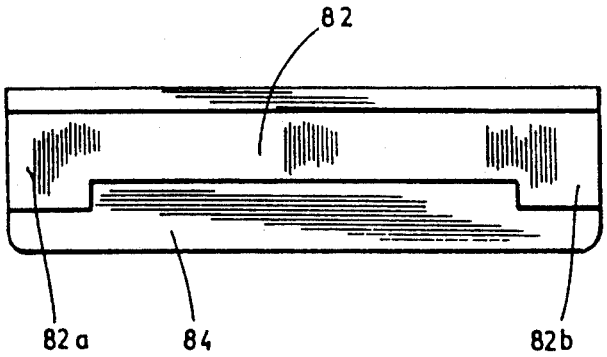
FIG. 11 is a face view taken along line 11—11 of FIG. 10.
Figure 10:
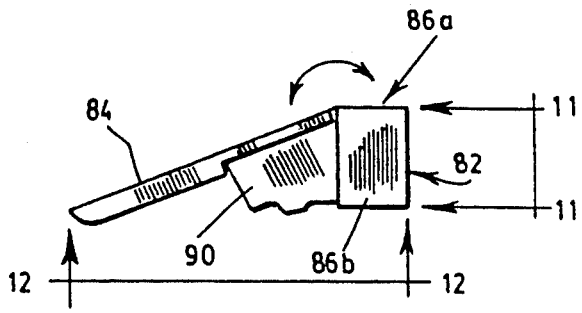
FIG. 10 is a side view of another version of a mountable front.

As can be seen in FIG. 8, the removably mountable front needs not be mounted on any intermediate but may be directly mounted on the tray using the slot extending along the longitudinal axis of its large wall.

Figure 9:
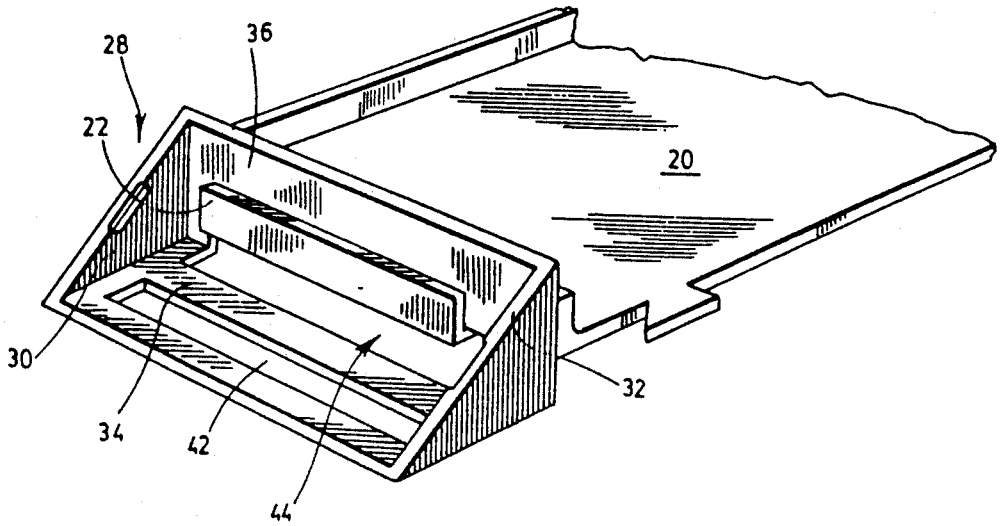
FIG. 9 is a perspective view of a mountable front as shown in FIG. 2 mounted on a display unit using the slot obtained from cuts made in its two perpendicular walls.

In FIG. 9, the removably mountable front is directly mounted o the tray using as coupling, the slot adjacent two sides.

Still in another embodiment as shown in FIGS. 2 and 4, the small wall (54) of the coupling intermediate (50) is provided with a tongue (70) to engage the groove (62) of the display unit shown in FIG. 2 to thereby releasably lock the small wall (54) to the display unit (20), while the large wall (52) of this intermediate is provided with a groove (72) to receive the tongue (64) or (66) of the removably mountable front.

Although the removably front has been shown triangularly shaped, it must be noted that its wall adjacent the display unit must be flat but its other walls may take various shapes, and the front may be polygonal, that is rectangular, pentagonal, hexagonal, heptagonal and the like.

Also the front wall (38) may be bulging, concave, convex.

The removably mountable front shown in FIG. 2 may also be provided with a decorative element such as L-shaped panel (80) to hide the slots (42), (44) for instance, and/or to receive samples.

Figure 12:
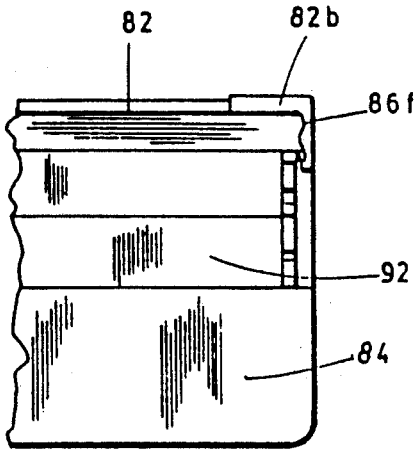
FIG. 12 is a view taken along line 12—12 of FIG. 10, showing the mountable front in an open position.
Figure 13:
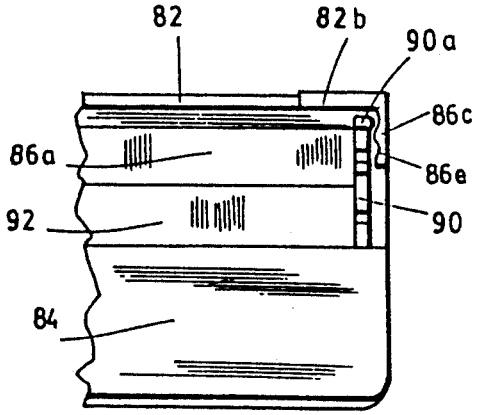
FIG. 13 is a view similar to FIG. 12, wherein said mountable front is in a closed position.

FIGS. 10 to 13 inclusive show other removably mountable fronts comprising a small wall (82) and a large wall (84), said small wall having a pair of legs (82*a*), (82*b*) projecting from its lower edge to slide between the L-shaped extension of a display unit as described hereinabove. The small wall (82) also has a U-shaped extension (86), defining top (86*a*) and sides (86*b*) and (86*c*), to bridge it to the large wall, the outermost edge of the top (86*a*) flexibly joining said large wall (84). Said large wall has sides (88), (90). The sides (86*b*, 86*c*) are provided with locking means. For instance, the sides of the large wall (88), (90) may be provided with bulging or male portions (90*a*) for engaging female portions (86*e*) and (86*f*) defined in each of the sides (86*b*), (86*c*) of the U-shaped extension, whereby, as shown in FIGS. 12 and 13, the large side may be allowed to move up and down and to lock in any one of the female portions (86*e*), as shown in FIG. 12, or (86*f*), as shown in FIG. 13.

Figure 14:
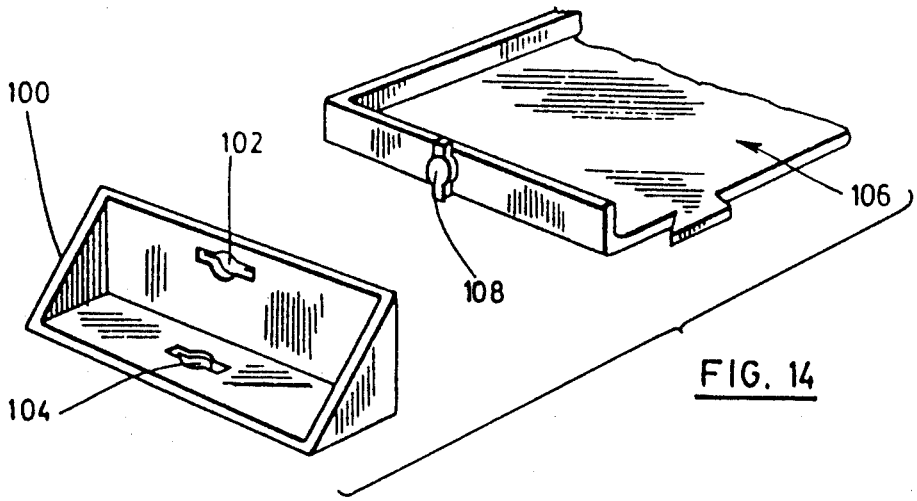
FIG. 14 is a perspective view of a removably mountable front releasably attached onto a display unit by means of a bayonet fitting.

The removably mountable front may be mounted on a display unit by numerous other means or attachments. For instance, FIG. 14 shows a removably mountable front (100) provided with grooves (102) and (104) and a display unit (106) provided with a corresponding male portion (108) to enable the front to be mounted on said display unit by means of a bayonet fitting.

Figure 15:
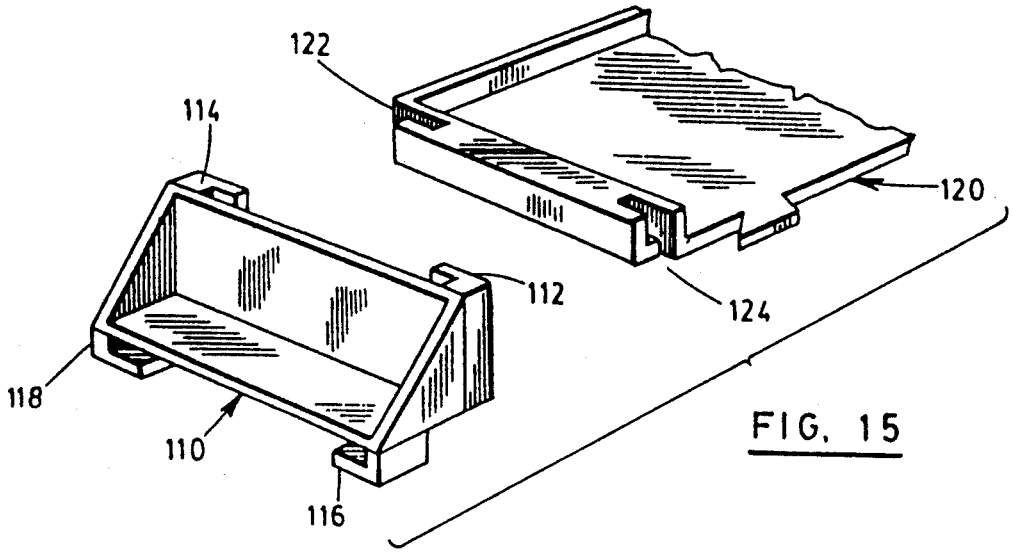
FIG. 15 is a perspective view of a removably mountable front slidably mountable onto a display unit.

FIG. 15 shows a mountable front (110) provided with pairs of L-shaped extensions (112), (114), (116), (118) and a display unit (120) with corresponding H-shaped members (122), (124), to allow said pair of L-shaped members to slide between said H-shaped members and thereby removably mounting said front to said display unit.

Figure 16:
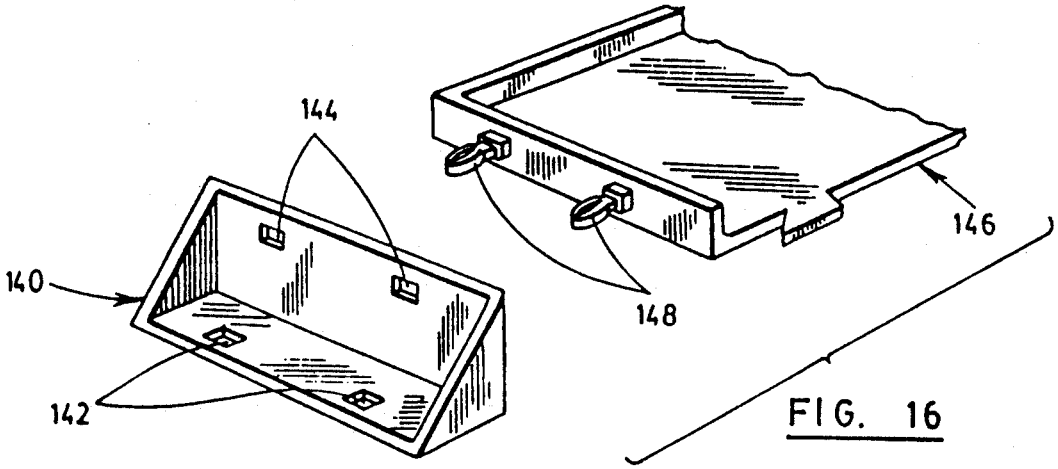
FIG. 16 is a removably mountable front slidably mountable on a display unit by means of a clip.

FIG. 16 shows another mountable front (140) having apertures (142), (144), which is slidably mounted on a display unit (146) by means of a clip (148). Any other means to attach the display unit to a removably mounted front is hereby envisaged. For instance, other means of sliding, aside from those shown in FIG. 15 may be used. Other anchoring means may also be used.

Although the present invention has been explained hereinabove by way of preferred embodiments thereof, it should be pointed out that any modifications to these preferred embodiments, within the scope of the appended claims, is not deemed to change or alter the nature and scope of the invention.

What is claimed is:

1. The combination of a display unit with a removably mountable front especially adapted for use therewith, said unit having a front wall on which said front is intended to be removably mounted, wherein said front comprises at least two walls joining each other at an angle; and wherein attaching means are provided on the front wall of said unit and on one of said walls of said front for attaching said front to said front wall in a removable manner, said attaching means comprising:

an L-shaped extension projecting forwardly and upwardly from the front wall of the unit, and at least one recess made in at least one of said walls of said front, said L-shaped extension and recess being sized and positioned to allow said L-shaped extension to be inserted through said recess and then the front to be slid down in a position where part of the one wall of said front is squeezed between the front wall of the unit and said L-shaped extension.

2. The combination of claim 1, wherein the L-shaped extension is on the same size as said at least one recess to transversally lock the front relative to the front wall of the unit when said front has been slid down into the L-shaped extension.

3. The combination of claim 2, wherein said at least two walls of said unit includes:

a first wall;

a second wall adjacent and perpendicular to the first wall;

a pair of said walls each in the form of a rectangular triangle, each of said side walls having two perpendicular edges adjacent and perpendicular said front and second walls, respectively, and a third free edge; and a third wall detachably connectable to the free edges of said side walls, said third walls once connected being inclined and sized to join said first and second walls, and thus to close said front.

4. The combination of claim 3, wherein the first and second walls of said front that are perpendicular to each other, are of different sizes and each provided with at least one of said at least one recess, whereby any one of said first and second walls can be used to attach said front to the front wall of the unit.

5. The combination of claim 4, wherein the largest one of said first and second walls is provided with at least two of said recesses.

6. The combination of claim 5, wherein at least some of said recesses consist of slots made in said first and second walls.

7. The combination of claim 6, wherein one of said slots extends on both of said first and second walls and is sized to be used with either one of said first and second walls.

8. The combination of claim 7, wherein all said slots are rectangular in shape.

9. The combination of claim 3, wherein said third inclined wall is transparent and a decorative element is mounted within the front behind said third wall to hide said at least to one recess in said first and second walls, and, whenever desired, to receive inscriptions and/or samples.

10. The combination of claim 6, wherein said third inclined wall is transparent and a decorative element is mounted within the front behind said third wall to hide said at least to one recess in said first and second walls, and, whenever desired, to receive inscriptions and/or samples.

11. The combination of claim 7, wherein said third inclined wall is transparent and a decorative element is mounted within the front behind said third wall to hide said at least to one recess in said first and second walls, and, whenever desired, to receive inscriptions and/or samples.

12. The combination of claim 3, further comprising:

a coupling intermediate that can be intercalated between said front and the front wall of said unit, said coupling intermediate comprising a large rectangular wall and a small wall pivotally mounted onto one longitudinal edges of said large rectangular wall, said large rectangular wall comprising an L-shaped extension similar to the one of the front wall of the unit to allow attachment of said front to said at least one recess, said small wall of said intermediate comprising a recess to allow attachment of said intermediate with the front attached thereto, to the L-shaped extension of the front wall of said unit.

13. The combination of claim 6, further comprising:

a coupling intermediate that can be intercalated between said front and the front wall of said unit, said coupling intermediate comprising a large rectangular wall and a small wall pivotally mounted onto one longitudinal edges of said large rectangular wall, said large rectangular wall comprising an L-shaped extension similar to the one of the front wall of the unit to allow attachment of said front to said at least one recess, said small wall of said intermediate comprising a recess to allow attachment of said intermediate with the front attached thereto, to the L-shaped extension of the front wall of said unit.

14. The combination of claim 7, further comprising:

a coupling intermediate that can be intercalated between said front and the front wall of said unit, said coupling intermediate comprising a large rectangular wall and a small pivotally mounted onto one longitudinal edges of said large rectangular wall, said large rectangular wall comprising an L-shaped extension similar to the one of the front wall of the unit to allow attachment of said front to said at least one recess, said small wall of said intermediate comprising a recess to allow attachment of said intermediate with the front attached thereto, to the L-shaped extension of the front wall of said unit.

15. The combination of claim 9, further comprising:

a coupling intermediate that can be intercalated between said front and the front wall of said unit, said coupling intermediate comprising a large rectangular wall and a small wall pivotally mounted onto one longitudinal edges of said large rectangular wall, said large rectangular wall comprising an L-shaped extension similar to the one of the front wall of the unit to allow attachment of said front to said at least one recess, said small wall of said intermediate comprising a recess to allow attachment of said intermediate with the front attached thereto, to the L-shaped extension of the front wall of said unit.

16. The combination of claim 11, further comprising: a coupling intermediate that can be intercalated between said front and the front wall of said unit, said coupling intermediate comprising a large rectangular wall and a small wall pivotably mounted onto one longitudinal edges of said large rectangular wall, said large rectangular wall comprising an L-shaped extension similar to the one of the front wall of the unit to allow attachment of said front to said at least one recess, said small wall of said intermediate comprising a recess to allow attachment of said intermediate with the front attached thereto, to the L-shaped extension of the front wall of said unit.

17. A combination of claim 3, wherein the front wall of said unit has at least one groove sized and positioned to receive tongues projecting from the first and second walls of said front, so as to releasably snap from said to said front wall of said unit.

18. A combination of claim 7, wherein the front wall of said unit has at least one groove sized and positioned to receive tongues projecting from the first and second walls of said front, so as to releasably snap said front to said front wall of said unit.

19. A combination of claim 9, wherein the front wall of said unit has at least one groove sized and positioned to receive tongues projecting from the first and second walls of said front, so as to releasably snap said front to said front wall of said unit.

20. A combination of claim 12, wherein the front wall of said unit has at least one groove sized and positioned to receive tongues projecting from the first and second walls of said front, so as to releasably snap said front to said front wall of said unit.

21. A combination of claim 15, wherein the front wall of said unit has at least one groove sized and positioned to receive tongues projecting from the first and second walls of said front, so as to releasably lock said front to said front wall of said unit.

* * * * *